United States Patent [19]

Eheim

[11] 4,073,277

[45] Feb. 14, 1978

[54] FUEL INJECTION PUMP FOR INTERNAL COMBUSTION ENGINES

[75] Inventor: Franz Eheim, Stuttgart, Germany

[73] Assignee: Robert Bosch GmbH, Stuttgart, Germany

[21] Appl. No.: 652,872

[22] Filed: Jan. 27, 1976

[30] Foreign Application Priority Data

Jan. 28, 1975 Germany ..... 2503324

[51] Int. Cl.[2] ..... F02M 59/42

[52] U.S. Cl. ..... 123/139 BD; 417/440; 417/441; 417/456; 417/505

[58] Field of Search ..... 123/139 E, 139 BD, 139 AA, 123/139 AZ, 139 DP, 198 DB, 139 ST, 179 L; 417/440, 441, 456, 505; 251/121, 129

[56] References Cited

U.S. PATENT DOCUMENTS

| | | | |
|---|---|---|---|
| 2,229,499 | 1/1941 | Fisette | 251/129 X |
| 3,661,130 | 5/1972 | Eheim | 123/139 EX |
| 3,733,047 | 5/1973 | Allen | 251/141 |
| 3,758,241 | 9/1973 | Eheim | 123/139 AP X |
| 3,861,833 | 1/1975 | Salzgeber et al. | 417/254 |
| 3,896,779 | 7/1975 | Omori et al. | 123/139 E |

FOREIGN PATENT DOCUMENTS

| | | | |
|---|---|---|---|
| 849,324 | 9/1952 | Germany | 417/441 |

*Primary Examiner*—Charles J. Myhre
*Assistant Examiner*—Tony M. Argenbright
*Attorney, Agent, or Firm*—Edwin E. Greigg

[57] ABSTRACT

A fuel injection pump for internal combustion engines has a simultaneously reciprocating and rotating pump piston which aspirates fuel from a fuel compartment and then delivers it under pressure to engine fuel lines. An electromagnetic valve can obturate the conduit between the fuel compartment and the pressure chamber of the pump, thereby shutting off fuel delivery. To permit manual override of this shut-off, the electromagnetic valve may be partially unscrewed from the pump housing, thereby lifting the valve closing member from its seat and permitting fuel flow. In another version, an externally accessible central valve bolt partially lifts the valve-closing member from its seat.

9 Claims, 3 Drawing Figures

FUEL INJECTION PUMP FOR INTERNAL COMBUSTION ENGINES

BACKGROUND OF THE INVENTION

The invention relates to a fuel injection pump for internal combustion engines including a fuel storage compartment kept at low pressure and connected to the pump pressure chamber by a conduit whose flow is controlled by a normally closed electromagnetic valve.

When internal combustion engines are equipped with a fuel injection pump of this type, they cannot be restarted when the electrical system fails, i.e., when the electromagnetic valve cannot be energized. Even though the reason the magnetic valve is installed in the normally closed manner is to provide safety when the electrical system fails, it must also be capable of permitting restarting the engine in appropriate emergency situations (for example, in engines installed in boats, or when the electrical system fails during extended cruising).

OBJECTS AND SUMMARY OF THE INVENTION

It is a principal object of the invention to provide a fuel injection pump of the general type described above which permits restarting the internal combustion engine when the electromagnetic valve is unenergized.

This object is attained, according to the invention, by providing a device which is entirely mechanical and can be actuated arbitrarily for connecting the pump pressure chamber with the fuel storage compartment. Thus, the operator of the internal combustion engine causes fuel to be delivered from the fuel storage compartment in the pump to the pressure chamber during the suction stroke of the fuel pump piston.

In a preferred embodiment of the invention, the fuel pump piston opens the fuel suction conduit during the suction stroke of the pump and the conduit opening device is a screw-threaded mechanism in the channel connecting the suction compartment and the pressure chamber. This screw-threaded mechanism may be, e.g., the entire electromagnetic valve which might be unscrewed from the pump housing so that an appropriate drag link lifts movable valve member from its seat. Alternatively, a separate bolt, centrally disposed in the valve, may accomplish this task.

According to yet another embodiment of the invention, there is provided a second fuel suction line which the pump piston opens during its suction stroke while the screw-threaded mechanism is a valve disposed in this second suction line.

The invention will be better understood as well as further objects and advantages become apparent from the ensuing detailed specification of preferred embodiments taken in conjunction with the drawing.

DESCRIPTION OF THE PREFERRED EMBODIMENT

Figure 1:
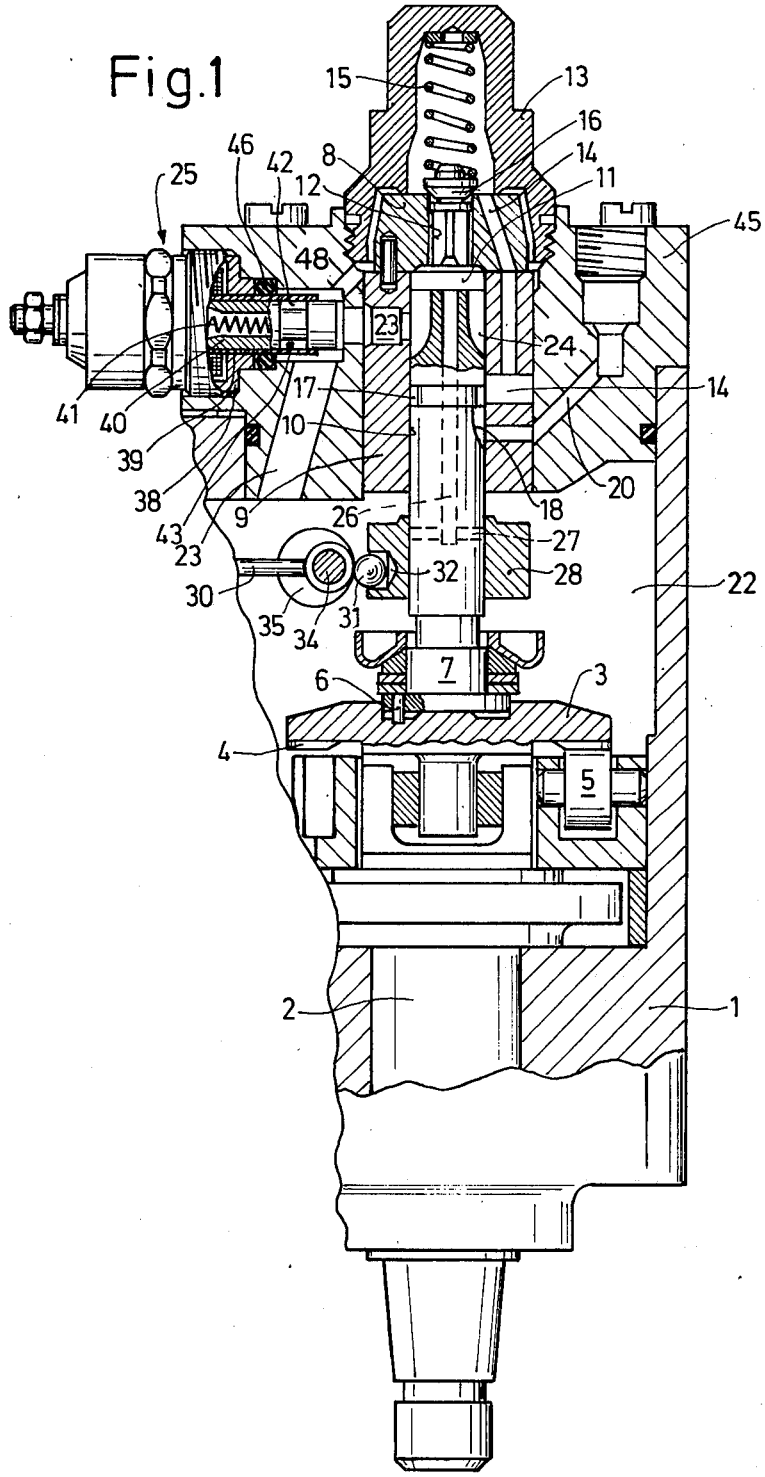
FIG. 1 is a partial longitudinal section through a fuel injection pump according to the invention including an electromagnetic valve, the movable valve member being opened by unscrewing the entire valve.

Turning now to FIG. 1, there is shown a fuel injection pump for multi-cylinder, internal combustion engines including a housing 1 in which is rotatably carried a drive shaft 2. Co-rotating with the drive shaft 2 is a frontal cam plate 3 provided with a plurality of cam lobes 4 which cooperate with locally-fixed rollers 5. The rotation of the drive shaft 2 due to means not shown causes rotation of the frontal cam plate 3 which is transmitted by a coupling member 6 to a pump piston 7 which is thereby made to undergo simultaneous reciprocating and rotating motion while being pressed on the cam plate 3 by spring means not shown. The number of cam lobes 4 and hence the number of piston strokes per revolution is equal to the number of cylinders in the engine.

The piston 7 moves in a bore 10 within a cylindrical bushing 9 closed on top by a valve carrier 8, thereby defining a working pressure chamber 11. An axial bore 12 in the valve carrier 8 connects the pressure chamber 11 with a blind chamber 13 which is connected by a line 14 to the cylindrical bore 10 in the bushing 9. The axial bore 12 may be obturated by a valve member 16 loaded by a spring 15. The connecting line 14 terminates radially into the cylinder bore 10, and an annular groove 17 located on the circumference of the pump piston and a longitudinal groove 18 connected thereto create a communication between the terminus of the connecting line 14 and sequential ones of the individual pressure lines 20 during each compression stroke of the piston. The pressure lines 20 lead to individual engine cylinders (not shown) and are equal in number to the number of engine cylinders.

During each compression stroke of the piston 7, fuel is delivered through the axial bore 12, which opens the valve member 16, and hence into the chamber 13, the connecting line 14 and through the distribution groove 18 to one of the pressure supply lines 20. During the downward, suction stroke of the piston, fuel flows from a slightly pressurized pump suction chamber 22 through a suction line 23 into the bore 10. The fuel flow from the suction chamber is controlled by a number of longitudinal grooves 24 on the pump piston, equal in number to the number of pressure lines 20. During the compression stroke of the piston, the rotation of the piston interrupts the communication between the suction line 23 and the longitudinal grooves 24 so that the entire fuel quantity supplied by the piston is delivered to one of the pressure lines 20. The suction conduit 23 is further controllable by an electromagnetic valve 25, as will be explained in detail below.

The amount of fuel delivered to the engine is controlled by changing the fuel flow from the pressure chamber 11 to the suction chamber 22 through a blind bore 26 in the pump piston 7 which connects with a transverse bore 27. Cooperating with the transverse bore 27 is a fuel quantity setting member 28, embodied as an annular slide displaceable on the outside surface of the pump piston, whose position determines the point of time at which the transverse bore 27 is opened when the pump piston moves upwardly, thus creating a communication between the pressure chamber 11 and the pump suction chamber 22. From this point on, the supply of fuel to the pressure line 20 is interrupted. By changing the position of the annular slide 28, the fuel quantity actually delivered to the engine may thus be adjusted.

The adjustment of the fuel quantity is performed by the engagement of a ball head 31 of a control lever 30 engaging a recess 32 in the annular slide 28. The control lever pivots about a point 34 whose position can be changed by an eccentric 35. The other end of the control lever 30 is engaged by a control spring in opposition to the force of an rpm signal generator. The bias tension of the control spring may be adjusted with an arbitrarily settable lever. When the engine rpm increases, the rpm signal generator acts to reduce the injected fuel quantity, whereas the spring urges the lever in the direction of increasing fuel quantity. The equilibrium position, which defines the actual injected fuel quantity, can be adjusted by the above mentioned lever.

FIG. 1 is only a partial section of a magnetic valve 25. The magnetic valve housing 38 includes a guide bushing 39 for the armature 40 which acts as the movable valve member. The armature 40 is also shown in partial section, thereby illustrating the closure spring 41. The armature 40 has an annular groove 42 into which extends a pin 43 disposed in the bushing 39 thereby acting as a drag link. A sealing ring 46 which guarantees complete sealing even during limited axial motions of the valve 25 is disposed between the guide bushing 39 and the pump head 45 in which the valve is located.

In order to permit opening of the suction channel 23 even when the magnetic valve is electrically de-energized (as shown in FIG. 1), the magnetic valve 25, which is threadedly engaged at the location 47 in the head 45, is partially unscrewed, so that the pin 43 contacts the armature 40 and lifts it from the valve seat 48. Thus, even when the electrical system of the internal combustion engine were to fail, the engine could be started nevertheless, because, during the suction strokes of the pump piston 7, fuel may flow from the suction compartment 22 through the supply line 23 and one of the longitudinal grooves 24 into the pump pressure chamber 11.

Figure 2:
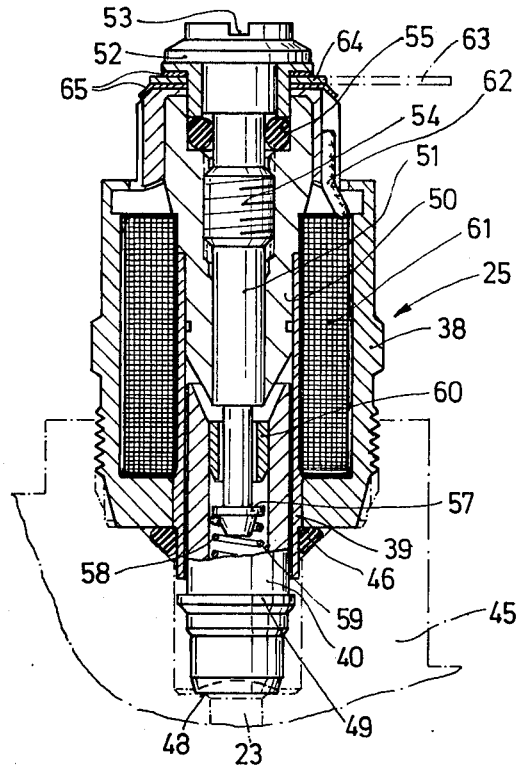
FIG. 2 is an enlarged illustration of another embodiment of an electromagnetic valve in which a central bolt actuates the valve member.

In a second embodiment of the magnetic valve 25, shown in FIG. 2, the valve housing 38 also has a guide bushing 39 which is sealed with respect to the distribution head 45 of the pump by an O-ring 46. The armature 40, serving as the movable valve member, has a shoulder 49 which serves to limit the stroke of the armature 40 with respect to the guide bushing 39. The mutually opposite end faces of the magnetic valve core 50 and the armature 40, respectively, are conical so as to maintain sufficient magnetic force even with large axial displacement.

A central bore of the core 50 includes a bolt 51 whose external head 52 has a slot 53 which can be engaged by a tool to turn the bolt 51. For this purpose, the internal bore of the core 50 is threaded at the location 54 and engages a threaded portion of the bolt 51. In order to maintain fluid sealing during axial displacement, an O-ring 55 is disposed between the core 50 and the bolt 51.

At its end remote from the head 52, the bolt 51 has a disc 57 which serves as the support for a closure spring 58. The spring 58 is located in a blind well 59 in the armature 40 into which also extends the bolt 51 and its disc 57. The bore 59 further includes a sleeve 60 which cooperates with the rear of the disc 57 to act as a drag link for moving the valve member 40 so that, when the electrical current fails, the movable valve member 40 may be lifted from its valve seat 48 by means of the bolt 51.

The magnetic coil 61 is electrically connected via a conductor 62 to a connecting device 63 including a ring 64, disposed between two insulating rings 65. The angular position of the connector device 63 may thus be chosen arbitrarily, and the end of the conductor 62 is either welded to the ring 64 or pressed against it by the bolt 51.

Figure 3:
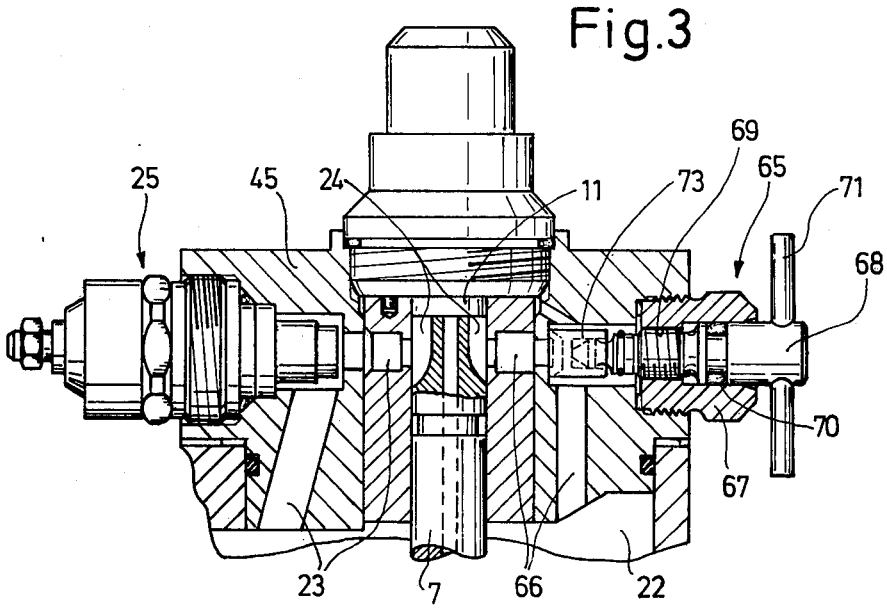
FIG. 3 illustrates the head of the fuel injection pump shown in FIG. 1, including a separate suction channel and a screw-thread valve located therein.

In the third exemplary embodiment of the invention shown in FIG. 3, the distributor head 45 includes the magnetic valve 25 as well as a screw-type valve 65. During the suction stroke of the piston pump, the longitudinal grooves 24 in the pump piston 7 open the supply conduit 23 and also open a second connection channel 66 which creates a communication between the pump pressure chamber 11 and the fuel suction compartment 22. The screw valve includes a bushing 67 threadedly fastened in the distributor head 45 and provided with a central bore containing an axially displaceable set screw 68 moving in threads 69. An O-ring 70 seals the gap between the set screw 68 and the bushing 67. A cross pin 72 permits external rotation of the set screw 68. The end of the set screw adjacent the supply line 66 carries a movable valve member 73 which can obturate the channel in the position shown in the figure. In the event of failure of the electrical system of the engine, in which the magnetic valve 25 normally closes the first supply conduit 23, the set screw 68 may be turned manually, thus opening the second fuel channel 66 by displacement of the movable valve member 73.

What is claimed is:

1. In a fuel injection pump including a housing, a fuel storage compartment, a cylinder in said housing, a piston moving reciprocatingly in said cylinder and defining a pressure chamber, at least one supply conduit between said compartment and said pressure chamber, a normally closed electromagnetic valve mounted in said housing for controlling the flow of fuel through said conduit, the improvement wherein:

further fuel control means are provided for controlling fluid communication between said compartment and said pressure chamber while said electromagnetic valve is in its normally closed, de-energized condition.

2. A fuel injection pump as defined by claim 1, wherein said fuel control means for controlling fluid communication is a member arranged to move in a bore in said housing and further includes obturating means arranged to extend into said conduit.

3. A fuel injection pump as defined by claim 2, wherein said member is said electromagnetic valve, the improvement further comprising sealing means disposed between said valve and said housing and wherein said valve has a casing and a movable valve closing member which is carried along in axial motion when said valve is axially displaced with respect to said housing.

4. A fuel injection pump as defined by claim 3, wherein said movable valve closing member is a magnetic armature of said valve, the improvement further comprising a bushing, affixed centrally in said valve, surrounding said armature and extending beyond said casing, and lost-motion linkage for connecting said bushing to said armature.

5. A fuel injection pump as defined in claim 1, wherein said means for controlling fluid communication is an axially disposed threaded bolt engaging threads in a casing for axial motion therein, provided with means for rotation from outside said casing, and wherein said valve includes a movable valve closing member, the improvement further comprising sealing means disposed between said bolt and said casing and lost-motion linkage connecting said bolt and said movable valve closing member.

6. A fuel injection pump as defined by claim 5, wherein said movable valve closing member is a magnetic armature which has a well into which extends said bolt, said lost-motion linkage including a sleeve gliding coaxially on said bolt and fastened in said well.

7. A fuel injection pump as defined by claim 1, the improvement further comprising another supply conduit in said housing for connecting said fuel compartment and said pressure chamber and wherein said means for controlling fluid communication is a screw-threaded valve member penetrating a casing and entering said other supply conduit.

8. A fuel injection pump as defined by claim 1, wherein said electromagnetic valve includes a stationary magnet core with a conical end face and wherein an end face of said armature adjacent said magnet core is also conical in complementary manner.

9. A fuel injection pump as defined by claim 1, the improvement further comprising stationary, non-magnetic tube means surrounding an armature, and wherein said armature has a shoulder which cooperates with an edge of said tube means to delimit the axial travel of said armature.

* * * * *